United States Patent [19]

Naud

[11] 4,216,878

[45] Aug. 12, 1980

[54] BINGO CHIP DISPENSER

[76] Inventor: Gaetan Naud, 330 St. Joseph, Donnacona Cté Portneuf, Quebec, Canada, G0A 1T0

[21] Appl. No.: 926,945

[22] Filed: Jul. 20, 1978

[51] Int. Cl.[2] ..... B65D 83/04; G07D 1/00

[52] U.S. Cl. ..... 221/264; 133/5 A; 267/171

[58] Field of Search ..... 221/264, 263, 93, 271, 221/276; 222/361, 362, 336, 339, 340; 294/55; 133/1 R, 1 A, 4 R, 5 R, 5 A, 8 A; 53/213, 254, 390; 141/108, 109, 391; 15/257.3, 257.1; 267/166, 170, 171, 179

[56] References Cited

U.S. PATENT DOCUMENTS

| | | | |
|---|---|---|---|
| 715,756 | 12/1902 | Clover | 15/257.3 |
| 774,994 | 11/1904 | Snedeker | 15/257.3 |
| 961,199 | 6/1910 | Armstrong | 15/257.3 |
| 3,115,992 | 12/1963 | Menolasio et al. | 221/276 X |
| 3,467,277 | 9/1969 | Tolliver | 221/264 |
| 3,802,729 | 4/1974 | Akre | 294/55 |
| 3,934,753 | 1/1976 | Curtiss | 221/93 |

*Primary Examiner*—F. J. Bartuska

[57] ABSTRACT

A bingo chip dispenser is described. This dispenser includes a one piece unit which is readily held by the player's hand and which includes a dispenser mechanism arranged between an upper tube for storing a stack of chips and a lower discharge tube serving to receive one chip discharged from the dispensing mechanism and which can be located at the exact spot on a bingo card to position the dispensed chip at this exact location.

3 Claims, 5 Drawing Figures

BINGO CHIP DISPENSER

BACKGROUND OF THE INVENTION

In the game of bingo, cards are provided with markings dividing the cards in a plurality of squares. Each player places a bingo chip, namely a thin disc, upon the square which has been called. Placing of the chips was previously done by hand which meant grasping of a thin chip from a supply and then having to place it exactly on the square being called. Older persons, who are normally the majority of bingo players, frequently have difficulties handling the bingo chips.

SUMMARY OF THE INVENTION

In accordance with the invention, there is provided a bingo chip dispenser which can be composed of molded synthetic resin and which can be easily held in one hand and manipulated to dispense one chip at the exact spot required on a bingo card from a supply of such chips carried in the dispenser itself.

In accordance with the invention, there is further provided a collector tube which can be easily manipulated to collect the chips on the bingo card, or other flat surface, and automatically will position the same in a stack to be transferred to the storage nipple of the dispenser itself.

Another feature of the dispenser in accordance with the invention resides in the fact that the spring of the dispenser mechanism used for returning the key member to its normal position and retain the same in said position is also used as a means to prevent removal of the key member from the slot of the table in which the key member is slidably mounted.

Another feature of the invention resides in the fact that the spring member can be easily inserted and removed from its position within the slot of the table through an opening made in one wall of the table.

DESCRIPTION OF THE PREFERRED EMBODIMENTS

Figure 1:
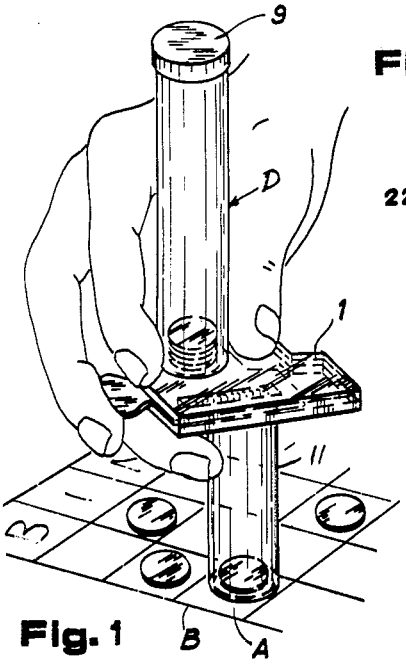
FIG. 1 illustrates in perspective view the bingo chip dispenser of the invention showing how it is used to dispense one chip on a bingo card.

Referring to FIGS. 1 to 7, the dispenser generally indicated at D comprises an elongated table 1 having a top wall 2 and a bottom wall 3 which are spaced from each other to define an elongated slot 4 fully opened at

5 and 5' at the front and rear ends of the table and slidably receiving a key member 6 having a protruding front end forming a finger piece 7. An upper, bingo chips storing nipple 8 is integrally connected with the top wall 2 of the table 1 and is freely opened at its two ends, its upper end being closed by a removable cover or cap 9 and its lower end being in full communication with the slot 4. The upper nipple 8 serves to store a stack of bingo chips 10 which consist of thin wafer-like discs.

Figure 2:
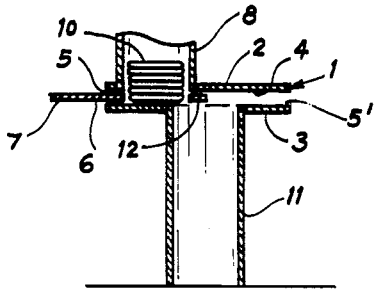
FIG. 2 is a vertical longitudinal section of part of the dispenser unit taken through the storage and dispenser nipples and showing the key member in normal position, FIG. 2 being a section taken along line 2—2 of FIG. 3.
Figure 3:
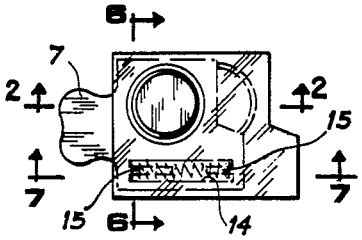
FIG. 3 is a top plan view of the dispenser in the position of FIG. 2.
Figure 4:
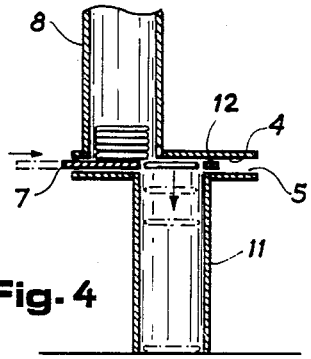
FIG. 4 is a vertical section similar to that of FIG. 2 but showing the key member in operating position for discharging a single chip down the discharge nipple.
Figure 5:
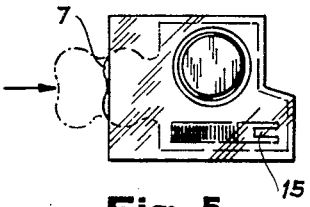
FIG. 5 is a bottom plan view of the dispenser unit with the key member in the operating position.
Figure 9:
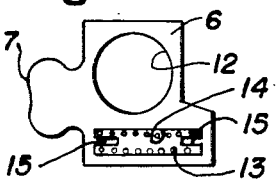
FIG. 9 is a top plan view of the key member.

The unit further includes a lower, discharge nipple 11 which is open at both ends with its upper end in full communication with the slot 4. Nipple 11 is offset relative to upper nipple 8 longitudinally of the table that is from front to back of the table. In the normal position of the key member 6 as shown in FIG. 2, a circular aperture 12 of said key member is in register with the upper nipple 8 to receive the lowermost bingo chip 10 of the stack of chips in the upper nipple 8. Upon slidable movement of the key member by pushing on the finger piece 7, the key member takes an operating position in which the key member displaces the single lowermost bingo chip and brings the same in register with the lower discharge nipple 11 as shown in FIG. 4. Obviously, the height of the slot 4 is only slightly greater than the thickness of the bingo chip 10 to allow transfer and dispensing of only one chip at a time.

The key member 6 is pushed to its operating position against the action of a compression coil spring 13 which returns the key member to its normal position after release of the finger piece 7.

Figure 6:
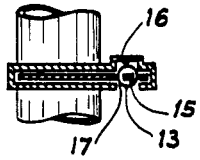
FIG. 6 is a cross-section taken along line 6—6 of FIG. 3.
Figure 7:
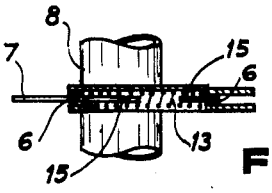
FIG. 7 is a section taken along line 7—7 of FIG. 3.

The key member 6 is a flat, thin platelike member which is die cut to form not only finger 7 and circular opening 12 but also an elongated aperture 14 extending longitudinally of the table and on one side of the table with respect to the nipples 8 and 11. The aperture 14 has a width slightly greater than the external diameter of the coil spring 13 so as to accomodate the same. The ends of the aperture 14 are formed with integral fingers 15 which extend towards each other and which are narrower than the aperture 14 so as to leave a gap on each side of each finger. The fingers then enter within the ends of the coil spring 13 so as to retain the coil spring within the elongated aperture 14. The top wall 2 of the table 1 is provided at its inside surface with an elongated groove 16 accomodating the top portion of the spring 13 as shown in FIG. 6 and FIG. 7. The groove 16 registers and is coextensive with an opening 17 made in the bottom wall 3 of the table 1 and accomodating the lower portion of the coil spring 13. Groove 16 and opening 17 are in register and coextensive with aperture 14 and with the coil spring 13 in the normal position of the key member 6 as shown in FIG. 7. In this position it is clearly shown that by compressing one end of the spring, the end of the spring can be made to clear the associated finger 15 and the coil spring removed through the bottom opening 17.

The reverse procedure is also possible so that it is very easy to assemble the parts: namely the key member is inserted through slot 4 and then spring 13 is inserted through bottom opening 17 and made to engage the two fingers 15.

With this arrangement, it will be seen, as shown in FIG. 7, that the ends of the coil spring abut against the ends of the groove 16 and the ends of the bottom opening 17 so that the key member 6 is resiliently maintained in its normal position and also against accidental removal of the key member 6 from within its slot 4 without having to have recourse to removable stop pins or the like. The table and nipples 8 and 11 can be molded as one unit; it is easy to insert the key member from either end of the fully opened slot 4 and then to position the coil spring 13 through the lower opening 17 of the table.

The dispenser unit is filled with a stack of chips 10 within the upper nipple 8 and then the opened upper end of the latter is closed by the cap 9. The device can then be used to dispense one chip 10 at a time on a selected spot A of a bingo card B by first placing the discharge tube 11 on the spot A and then simply pressing on the finger piece 7 as shown in FIG. 1. Since the lower end of the discharge nipple 11 is free of any obstruction, it is easy to select the exact spot on which one wishes to deposit a chip 10.

Figure 8:
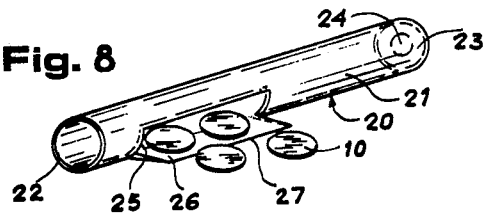
FIG. 8 is a perspective view of the bingo chip collector unit.

At the end of the game, several chips normally lay on the bingo card A and around the same. The collector unit 20 as shown in FIG. 8 can be used to advantage to collect all these bingo chips 10 to then transfer them back into the upper storage nipple 8 of the dispenser unit 1. The collector unit 20 simply consists of a tube 21 of an internal diameter slightly greater than the diameter of the chips 10. Tube 20 is fully opened at its end 22 while its other end is partially closed by an end wall 23 having a central hole 24. The side wall of tube 20 near its open end 22 is provided with an elongated generally rectangular window 25, from one longitudinal edge of which extends a collecting shelf 26 also of rectangular shape. This shelf tapers outwardly to a thin outer longitudinal edge 27 and the shelf lies in a plane which is tangent to the cylindrical surface of the tube 20 at the longitudinal edge of the window 25 from which the shelf 26 extends. Thus, the tube can be moved laterally along a flat surface such as the bingo card B to collect the bingo chips lying on such a card. The chips enter the tube, then the latter is turned with its open end 22 uppermost so that the chips will form a stack against end wall 23. When sufficient chips have been collected in the tube 20, the same are transferred to the storage upper nipple 8 of the dispenser unit 1 and the collecting operation can be repeated. Circular hole 24 is used to insert a thin object to displace the chips if the latter become wedged in an improper inclined position. Thus, formation of a proper stack can be formed in tube 20 to be later transferred as a stack within nipple 8.

What I claim is:

1. A chip dispenser comprising an elongated table having upper and lower walls having inside surfaces spaced from each other and defining a horizontal slot in the table intermediate the upper and lower walls, an upper tubular nipple extending upwardly from said upper wall, a lower tubular nipple spaced longitudinally from the upper nipple and depending from the lower wall, both nipples being in open communication with the slot through the respective walls, an elongated flat key member slidably mounted in the slot and removable therefrom, the key member having both a circular aperture and an elongated aperture formed therethrough, a finger piece at one end of said key member, said key member longitudinally displacable in said slot between a normal position in which said circular aperture registers with said upper nipple to receive one chip and an operative position in which said circular aperture is in register with said lower nipple to discharge said last named chip through said lower nipple, said elongated aperture being located on one side of said circular aperture relative to said key member and extending longitudinally of the latter, a finger protruding from each end of said elongated aperture in the plane of said flat key member and spaced from the longitudinal edges of said elongated aperture, the two fingers extending towards but spaced from each other, a compression coil spring disposed within said elongated aperture and receiving said fingers at both ends whereby said spring is retained within said elongated aperture by said fingers, said lower wall having an elongated opening made therethrough in register and coextensive with said elongated aperture in the normal position of said key member for insertion and retrieval of said spring therethrough by compressing the coil spring to clear at least one finger, said upper wall having a groove at its inside surface registering and coextensive with said elongated opening and accomodating the top portion of said coil spring, said elongated opening accomodating the lower portion of said coil spring, the ends of said groove and of said elongated opening forming abutment surfaces between which said spring is confined whereby said spring is compressed by movement of said key member in either one of two opposite directions with respect to its normal position, said spring member consequently not only returning said key member from its operative to its normal position upon release of said finger piece, but also preventing removal of said key member from within said slot.

2. A chip dispenser as claimed in claim 1 wherein the assembly of said upper and lower nipples and of said elongated table form a one piece unit of molded synthetic resin, said key member and said finger piece form a second unit made of synthetic resin and said coil spring forms a third independent unit.

3. A chip dispenser as claimed in claim 1 further including a cap for removably closing the upper end of said upper tubular nipple.

* * * * *